US007634926B2

(12) United States Patent
Park et al.

(10) Patent No.: US 7,634,926 B2
(45) Date of Patent: Dec. 22, 2009

(54) MECHANISM FOR MOUNTING MOTOR OF WASHING MACHINE AND WASHING MACHINE USING THE SAME

(75) Inventors: Gwan Ryong Park, Seoul (KR); Seung Chul Park, Gwangmyeong-si (KR); Jae Hyun Kim, Sungnam-si (KR)

(73) Assignee: LG Electronics Inc., Seoul (KR)

( * ) Notice: Subject to any disclaimer, the term of this patent is extended or adjusted under 35 U.S.C. 154(b) by 802 days.

(21) Appl. No.: 11/143,595

(22) Filed: Jun. 3, 2005

(65) Prior Publication Data

US 2006/0191301 A1 Aug. 31, 2006

(30) Foreign Application Priority Data

Feb. 25, 2005 (KR) ..... 10-2005-0015822

(51) Int. Cl.
*D06F 37/20* (2006.01)

(52) U.S. Cl. ..... 68/140; 68/23.1

(58) Field of Classification Search ..... 68/140
See application file for complete search history.

(56) References Cited

FOREIGN PATENT DOCUMENTS

| | | | |
|---|---|---|---|
| DE | 2 9708588 | | 8/1997 |
| DE | 1 9963703 | | 7/2001 |
| GB | 2332212 | | 6/1999 |
| KR | 10-2000-0012926 | * | 3/2000 |

OTHER PUBLICATIONS

English Language Abstract of KR 10-2000-0012926.
English language Abstract of DE 19963703.
English language Abstract of DE 29708588.

* cited by examiner

*Primary Examiner*—Michael Barr
*Assistant Examiner*—Jason P Riggleman
(74) *Attorney, Agent, or Firm*—McKenna Long & Aldridge LLP

(57) ABSTRACT

A mechanism for mounting a motor driving a drum to a tub of a washing machine, and a washing machine using the same are provided. The mechanism includes a motor located on the outer surface of a tub; at least one fixing member passing through a part of the motor and then fixed to the tub to fix the motor to the tub; and at least one isolator provided between the motor and the fixing member to prevent the fixing member from directly contacting the motor to prevent the vibration of the motor from being transmitted to the tub through the fixing member.

16 Claims, 5 Drawing Sheets

MECHANISM FOR MOUNTING MOTOR OF WASHING MACHINE AND WASHING MACHINE USING THE SAME

This application claims the benefit of the Korean Patent Application No. 10-2005-0015822, filed on Feb. 25, 2005, which is hereby incorporated by reference as if fully set forth herein.

BACKGROUND OF THE INVENTION

1. Field of the Invention

The present invention relates to a washing machine, and more particularly, to a mechanism for mounting a motor driving a drum on a tub of a washing machine and a washing machine using the same.

2. Discussion of the Related Art

Generally, washing machines are representative household electric appliances for washing laundry using a detergent and water. Such washing machines are divided into a top loading type and a front loading type according to positions of openings for putting the laundry into the washing machines therethrough.

The top loading-type washing machine usually comprises a tub vertically erected for containing laundry, a pulsator rotated in the tub for washing the laundry, and a lid provided on the upper surface of the washing machine for opening and closing the tub. The top loading-type washing machine washes the laundry using frictional force between the laundry and a water current generated by laterally rotating the pulsator, and is advantageous in that the washing machine has a short washing time, a high volume, and a low price. However, the top loading-type washing machine is disadvantageous in that the laundry is easily entangled and is severely damaged.

The front loading-type washing machine usually comprises a drum and a tub horizontally disposed for containing laundry, a plurality of lifters provided on the inner surface of the drum for lifting and dropping the laundry when the drum is rotated, and a door provided on the front surface of the washing machine for opening and closing the drum. The front loading-type washing machine washes the laundry by rotating the drum at a low speed under the condition that water, a detergent, and the laundry are introduced into the drum, and is advantageous in that the laundry is scarcely damaged and entangled and the consumption of water is small.

A driving motor for driving the pulsator or the drum is provided in the above top-loading or the front-loading washing machine. Conventionally, the driving force of the driving motor was indirectly transmitted to the pulsator or the drum through a power transmission member, such as a belt. However, recently, the driving force of the driving motor is directly transmitted to the pulsator or the drum owing to the development of related technology. In the washing machine having a mechanism directly transmitting the driving force of the motor to the pulsator or the drum, the driving motor is usually installed on the outer surface of the tub by fixing members, and a shaft of the driving motor passes through the tub and is then connected to the pulsator or the drum. Accordingly, the vibration generating from the driving motor is indirectly transmitted to the tub through the fixing members, or is directly transmitted to the tub, thereby generating deformation and fatigue crack of the tub, and noise.

SUMMARY OF THE INVENTION

Accordingly, the present invention is directed to a mechanism for mounting a motor of a washing machine and a washing machine using the same that substantially obviate one or more problems due to limitations and disadvantages of the related art.

An object of the present invention is to provide a method for mounting a motor of a washing machine, which prevents vibration of the motor, generated during driving, from being transmitted to a tub, and a washing machine using the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a mechanism for mounting a motor of a washing machine includes a motor located on the outer surface of a tub; at least one fixing member passing through a part of the motor and then fixed to the tub for fixing the motor to the tub; and at least one isolator provided between the motor and the fixing member for preventing the fixing member from directly contacting the motor to prevent the vibration of the motor from being transmitted to the tub through the fixing member.

Each of the isolator may include a spacer provided between a head of the fixing member and the tub for supporting the fixing member; and a bushing provided between the spacer and the motor for absorbing the vibration of the motor. Here, the spacer may be made of a hard material, and the bushing may be made of elastic rubber.

The spacer may separate the head of the fixing member from the motor, and separate the fixing member from the bushing. The spacer may be inserted into the bushing by push fit, and the bushing may be inserted into a hole of the motor by push fit.

The bushing may include at least one enlarged part extended from the outer cylindrical surface thereof in the radial direction and contacting the inner surface of a hole of the motor, through which the fixing member passes. In this case, the enlarged part may be provided on upper and lower portions of the bushing.

The spacer may include a flange protruded from the outer surface thereof in the radial direction; and the bushing may include a recess provided in the inner surface thereof for receiving the flange. In thus case, the flange may be provided at one end of the spacer such that the flange contacts the tub to disperse the force of the fixing member.

In another aspect of the present invention, a washing machine includes a case; a tub provided in the case, and including at least one first hole provided in the outer surface thereof; a drum rotatably provided in the tub; a stator located on the outer surface of the tub, and including at least one second hole corresponding to the first hole; a rotor connected to the drum by a driving shaft passing through the tub for rotating the drum through the driving shaft when power is applied to the stator; at least one fixing member passing through the second hole and then inserted into the first hole for fixing the stator to the tub; and at least one isolator provided between the inner surface of the second hole and the fixing member for preventing the fixing member from directly contacting the stator to prevent the vibration of the stator from being transmitted to the tub through the fixing member.

The isolator may include a spacer made of a hard material and provided in the second hole for supporting the fixing member; and a bushing made of a soft material and provided between the outer surface of the spacer and the inner surface of the second hole for absorbing the vibration of the stator. The spacer may separate the fixing member from the bushing and the stator. The spacer may be inserted into the bushing by push fit, and the bushing may be inserted into the second hole by push fit.

The bushing may include enlarged parts extended from upper and lower portions thereof in the radial direction and contacting the inner surface of the second hole. The spacer may include a flange protruded from the outer surface thereof in the radial direction; and the bushing may include a recess provided in the inner surface thereof for receiving the flange. The flange may be provided at one end of the spacer such that the flange contacts the tub to disperse the force of the fixing member.

In yet another aspect of the present invention, a washing machine includes a case; a tub provided in the case; a drum rotatably provided in the tub; a motor located on the outer surface of the tub for driving the drum through a driving shaft passing through the tub; at least one fixing member passing through a part of the motor and then fixed to the tub for fixing the motor to the tub; a spacer provided between a head of the corresponding fixing member and the tub for supporting the fixing member and separating the fixing member from the motor; and a bushing provided between the corresponding spacer and the motor for preventing the vibration of the motor from being transmitted to the tub through the fixing member.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiment of the present invention, examples of which are illustrated in the accompanying drawings. Wherever possible, the same reference numbers will be used throughout the drawings to refer to the same or like parts.

Figure 1:
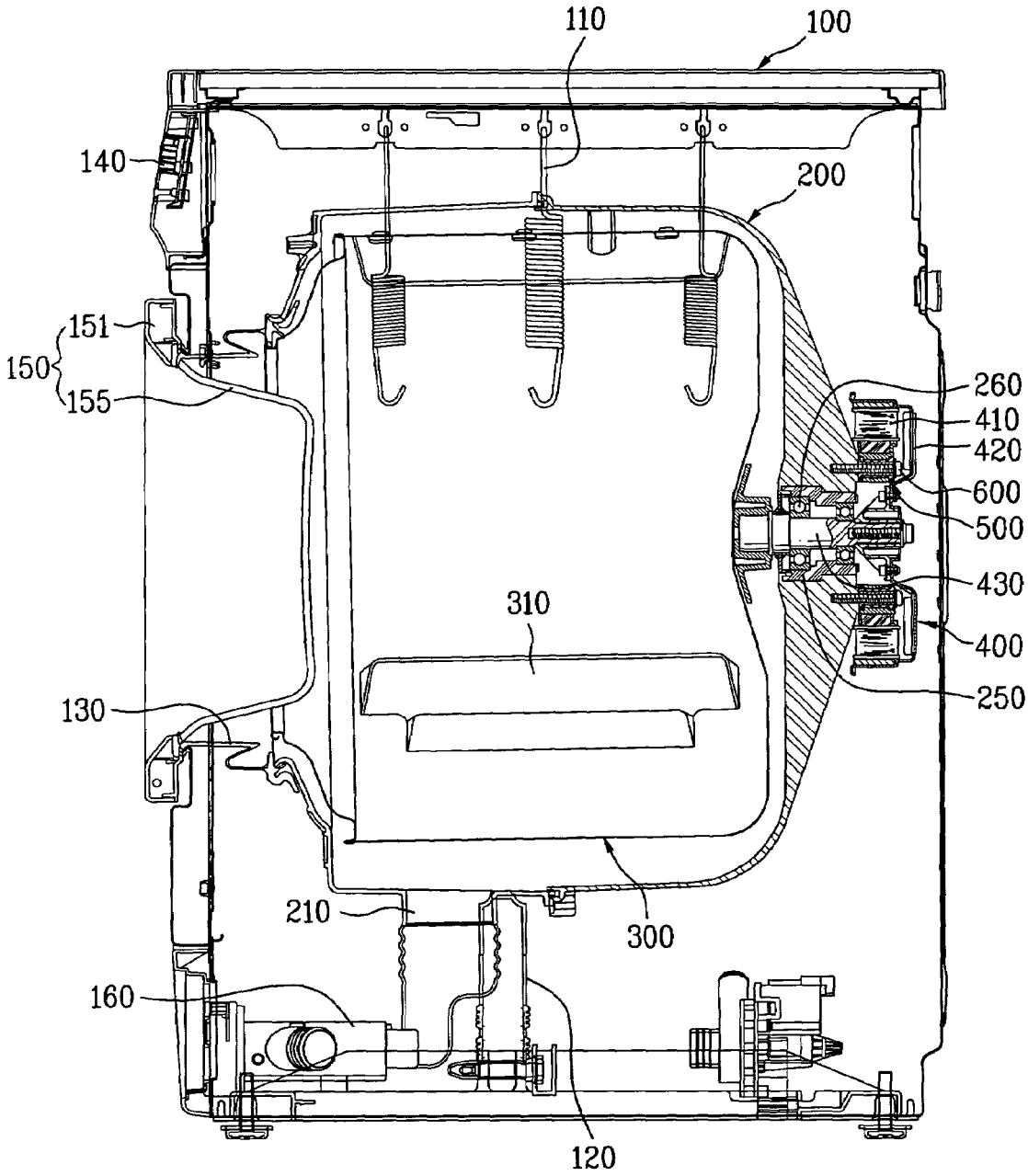
FIG. 1 is a sectional view of a washing machine in accordance with the present invention.

FIG. 1 is a sectional view illustrating the internal structure of a washing machine in accordance with the present invention. FIG. 1 illustrates a front loading-type drum washing machine comprising a tub 200 installed in a case 100 for containing washing water, and a drum 300 rotatably installed in the tub 200 for containing laundry. Here, the tub 200 and the drum 300 are installed in the horizontal direction. However, the present invention is not limited to the front loading-type drum washing machine shown in FIG. 1, but may be applied to a top loading-type pulsator washing machine, in which a tub and a drum are installed in the vertical direction. Hereinafter, the front loading-type drum washing machine shown in FIG. 1 will be described in detail.

With reference to FIG. 1, an opening for putting and taking laundry into and out of the washing machine therethrough is formed through the front surface of the case 100 of the washing machine. The opening is opened and closed by a door 150 hinged to the front surface of the case 100. The door 150 includes a door frame 151, and a door glass 155 installed in a hole formed through the central portion of the door frame 150. Accordingly, a user can see the inside of the washing machine, more particularly the inside of the drum 300, which will be described later in detail, through the door glass 155. Further, a control panel 140 for manipulating the washing machine is installed on the upper portion of the front surface of the case 100.

The tub 200 for containing laundry is provided in the case 100. As shown in FIG. 1, the tub 200 is suspended to the case 100 by a plurality of springs 110 and dampers 120. The springs 110 and the dampers 120 damp the vibration of the tub 200 generated when the washing machine is driven as well as support the tub 200.

A gasket 130 is installed between the tub 200 and the opening of the case 100. The gasket 130 prevents the washing water and the laundry, contained in the tub 200, from being discharged to the outside of the tub 200 and then introduced into the case 100. Although not shown in the drawings, a water supply hose for supplying the washing water to the inside of the tub 200 is connected to the upper surface of the tub 200. Further, a drain 210 is provided under the lower surface of the tub 200, and a drainage pump 160 for pumping the washing water in the tub 200 to the outside through the drain 210 is connected to the drain 210.

The drum 300 is rotatably installed in the inner space of the tub 200. Although not shown in the drawings, a plurality of through holes are formed through the cylindrical surface of the drum 300. Thus, the washing water contained in the tub 20 flows to the inside of the drum 300 through the through holes. A plurality of lifters 310 are protruded from the inner cylindrical surface of the drum 300. The lifters 310 lift and then drop the laundry when the drum 300 is rotated.

A motor 400 for driving the drum 300 is installed on the outer surface of the tub 200, more particularly, on the rear surface of the tub 200. The motor 400, for example, is a brushless DC motor including a stator 410, a rotor 420, and a driving shaft 430. The motor 400 is installed on the rear surface of the tub 200 by fixing members 600 passing through a part of the motor 400. Here, an isolator 500 is provided between each of the fixing members 600 and the motor 400. The isolators 500 prevent the motor 400 from directly contacting the fixing members 600 and the tub 200, thereby preventing the vibration of the motor 400 from being indirectly transmitted to the tub 200 through the fixing members 600 or being directly transmitted to the tub 200.

Hereinafter, a mechanism for mounting the motor of the washing machine of the present invention will be described in detail with reference to FIGS. 1 to 6A.

Figure 2:
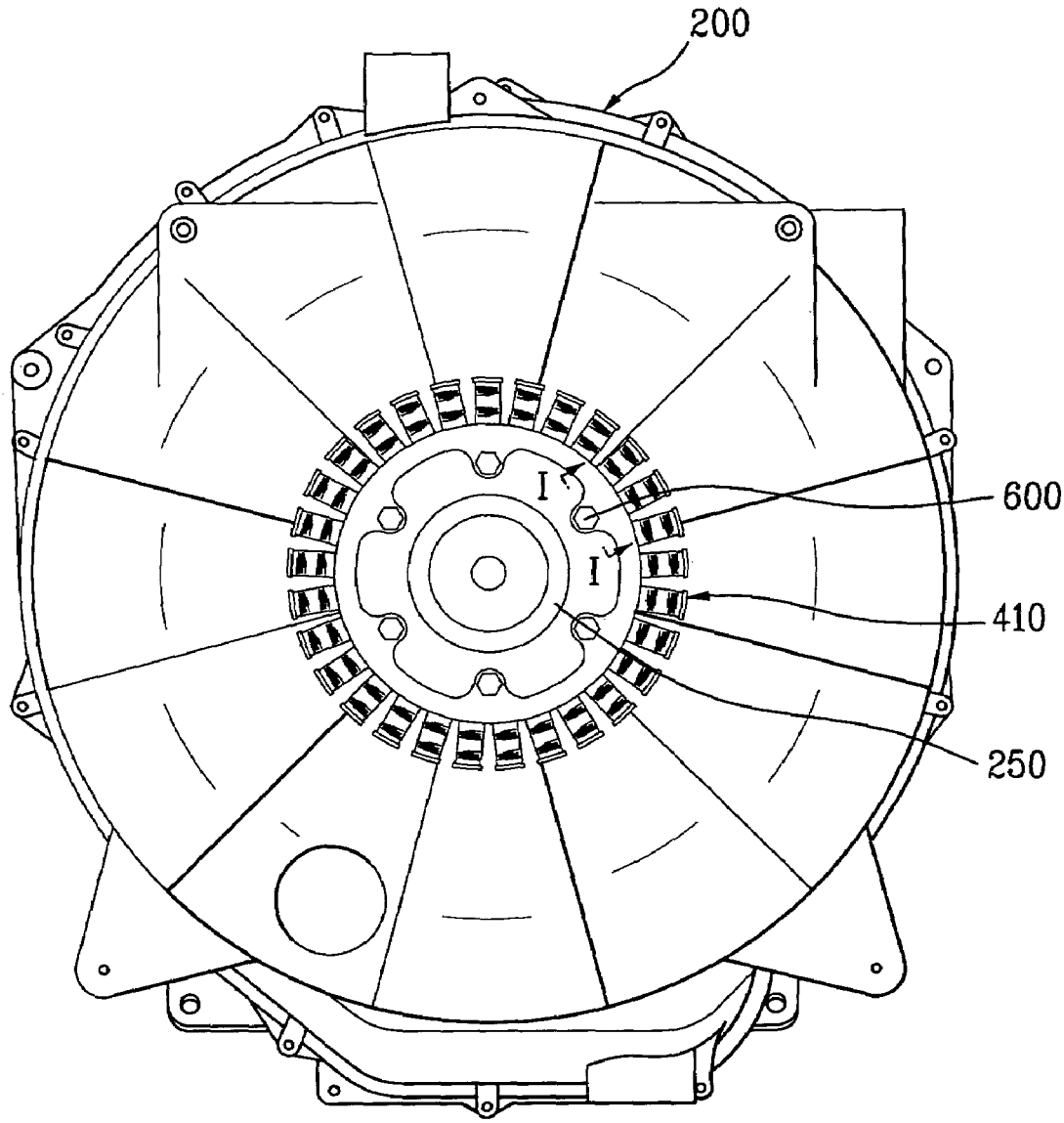
FIG. 2 is a rear view of a tub, to which a stator of a motor is attached.

As shown in FIG. 2, the stator 410 of the motor 400 is installed on the outer surface of the tub 200, for example, the rear surface of the tub 200. At least one first hole 220 (with reference to FIG. 3) is formed through the rear surface of the tub 200, and a second hole 411 corresponding to the first hole 220 is formed through the stator 410. The isolator 500 is inserted into the second hole 411, and the fixing member 600 passes through the isolator 500 and is then inserted into the first hole 220 of the tub 200. As described above, the stator 410 is fixed to the rear surface of the tub 200 by the fixing members 600 and the isolators 500. Here, the fixing members 600 contact the isolators 500, but do not contact the stator 410. Thereby, the vibration of the stator 410, generated when the motor 400 is driven, is not directly transmitted to the tub 200 through the fixing members 600.

Figure 3:
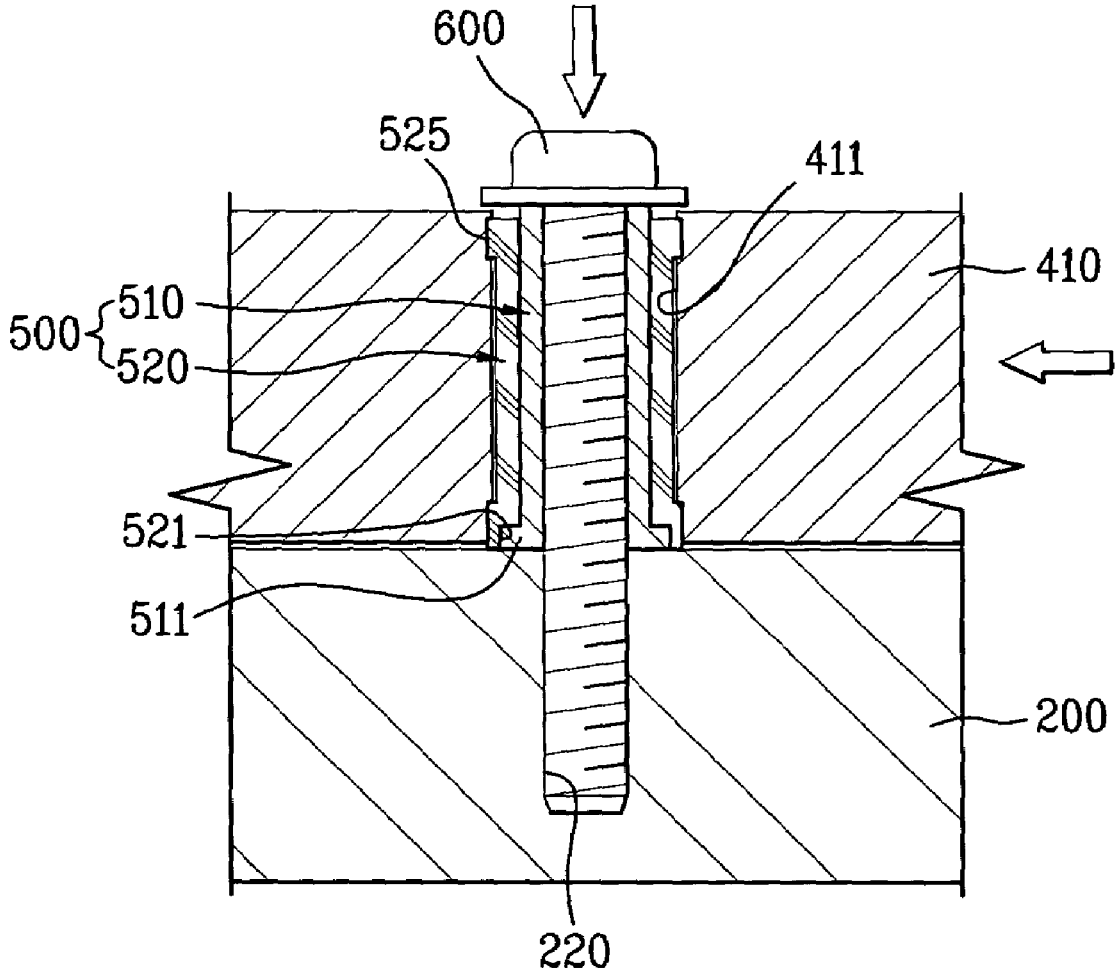
FIG. 3 is a sectional view taken along the line I-I of FIG. 2.
Figure 4:
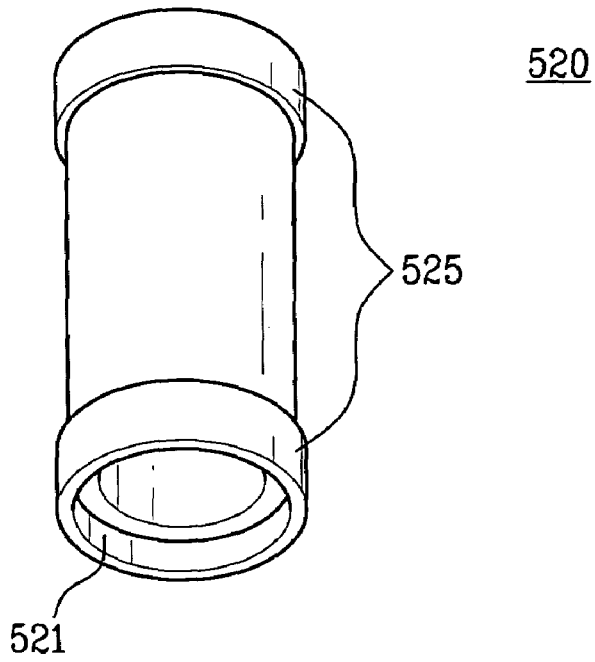
FIG. 4 is a perspective view of a bushing of FIG. 3.
Figure 5:
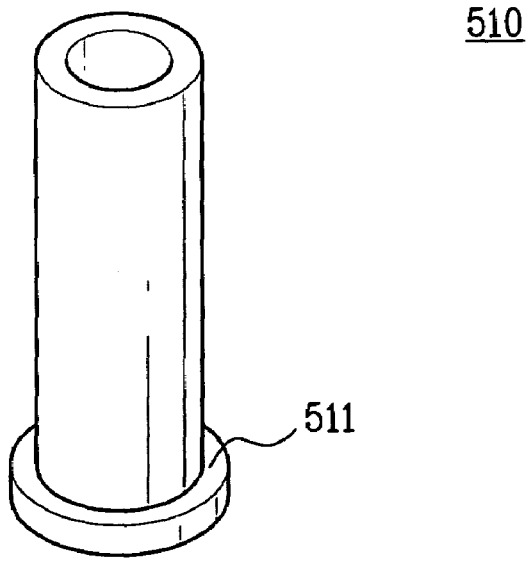
FIG. 5 is a perspective view of a spacer of FIG. 3.

As described above, each of the isolators 500 for preventing the vibration of the motor 400 from being transmitted to the tub 200 through the fixing members 600, for example, includes a spacer 510 and a bushing 520, as shown in FIGS. 3 to 5. The spacer 510 and the bushing 520 have a cylindrical shape, and the spacer 510 is inserted into the inner cylindrical surface of the bushing 520.

More specifically, the bushing 520 is made of rubber having high elasticity, and is fixedly inserted into the second hole 411 of the stator 410 by push fit. At least one enlarged part 525 extended in the radial direction of the bushing 520 is formed on the outer cylindrical surface of the bushing 520. The enlarged part 525 elastically contacts the inner surface of the second hole 411 when the bushing 520 is inserted into the second hole 411 of the motor 400 by push fit, thereby preventing the bushing 520 from being separated from the second hole 411. The enlarged part 525, for example as shown in FIG. 4, is formed on the upper and lower portions of the bushing 520. The upper and lower enlarged parts 525 are stably fixed to the second hole 411. The middle part of the bushing 520 between the upper and lower enlarged parts 525, which has a smaller diameter than that of the upper and lower enlarged parts 525, reduces frictional force generated when the bushing 520 is inserted into the second hole 411 by push fit. Thereby, the bushing 520 is easily installed in the second hole 411.

Figure 6A:
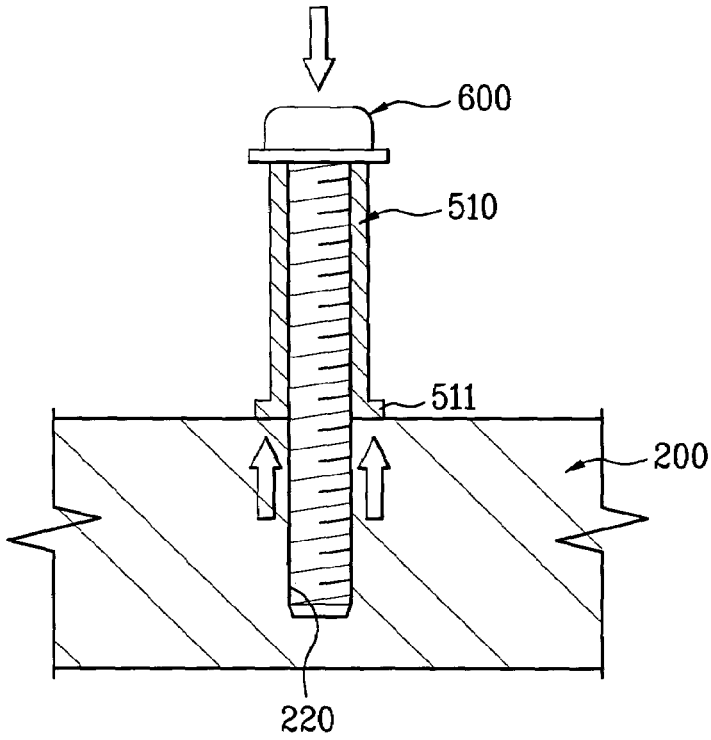
FIG. 6A is a diagram illustrating force applied to the spacer when fixing members are fixed to the tub.
Figure 6B:
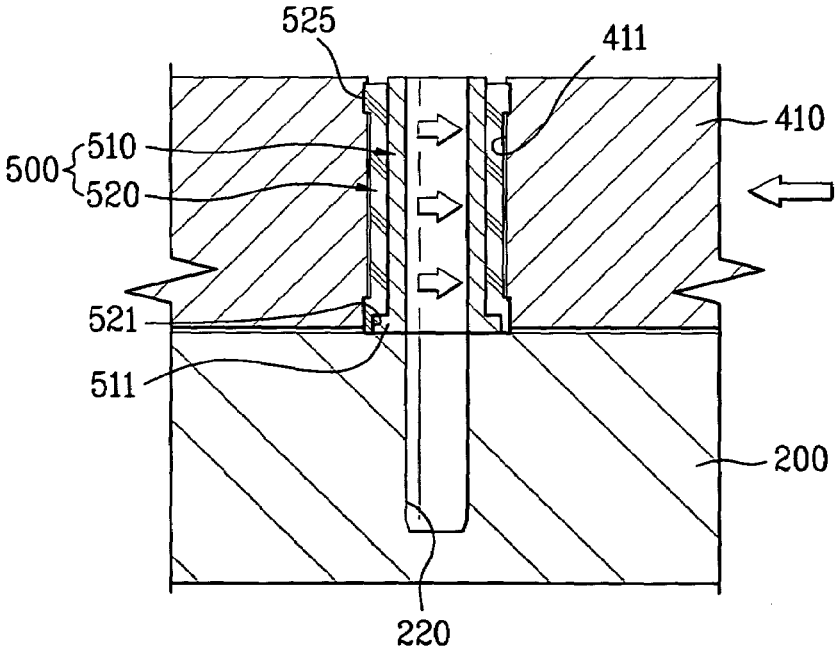
FIG. 6B is a diagram illustrating force applied to the bushing and the spacer when the stator of the motor is laterally vibrated.

The cylindrical spacer 510, through which the fixing member 600 passes, is made of a hard material, such as metal or synthetic resin, and is fixed to the inner cylindrical surface of the elastic bushing 520 by push fit. The upper end of the spacer 510 supports the head of the fixing member 600, for example, the head of a bolt, and the lower end of the spacer 510 is supported by the tub 200. Accordingly, as shown in FIGS. 6A and 6B, the spacer 510 located between the head of the fixing member 600 and the tub 200 supports the fixing member 600, and resists the fixing force of the fixing member 600 fixing the motor 400 to the tub 200.

The spacer 510, as shown in FIG. 3, has a larger length than that of the bushing 520. Thereby, the head of the fixing member 600 is separated from the bushing 520. Further, the spacer 510 is longer than the second hole 411 of the stator 410. Thereby, the head of the fixing member 600 is separated from the stator 410, and the stator 410 is separated from the tub 200.

That is, the spacer 510 separates the fixing member 600 from the bushing 520 and the stator 410 of the motor 400. Further, the spacer 510 separates the stator 410 of the motor 400 from the tub 200. Thus, since the vibration of the motor 400 is transmitted only to the elastic bushing 520, and the bushing 520 between the spacer 510 and the motor 400 absorbs the above vibration, the vibration of the motor 400 is not transmitted to the tub 200 differently from the conventional washing machine.

A flange 511 protruded in the radial direction of the spacer 510 is provided on the outer surface of the spacer 510, and-a recess 521 for receiving the flange 511 is provided in the inner surface of the bushing 520. The flange 511 and the recess 521 prevent the spacer 510, inserted into the bushing 520 by push fit, from slipping in the lengthwise direction of the bushing 520. The flange 511 may be provided at any portion of the outer surface of the spacer 510. For reference, FIGS. 3 to 6B illustrate an example of the flange 511, which is provided at the lower end of the spacer 510. In this case, the flange 511 contacts the tub 200, thereby dispersing the fixing force of the fixing member 600 applied to the tub 200.

The central portion of the stator 410 is hollowed so that the driving shaft 430 passes through the stator 410. A bearing 260, for supporting the driving shaft 430, and a bearing housing 250 are provided on the rear surface of the tub 200. One end of the driving shaft 430 passes through the stator 410 and the tub 200, and is then connected to the rear surface of the drum 300. Further, as shown in FIG. 2, the other end of the driving shaft 430 is fixed to the rotor 420 surrounding the stator 410.

In the operation of the washing machine, when power is applied to the stator 410, the rotor 420 is rotated, and thus the driving shaft 430 rotates the drum 300. When the rotor 420 is rotated, the repulsive force in the opposite direction of the rotated direction of the rotor 420 is applied to the stator 410, thereby vibrating the stator 410. The stator 410 may be vibrated in the lateral direction, as shown in FIG. 6B, or may be vibrated in the longitudinal direction although not shown in the drawings.

When the stator 410 is vibrated in the lateral direction, the vibration of the stator 410 is transmitted to the elastic bushing 520 provided between the spacer 510 and the stator 410. Then, the bushing 520 absorbs the transmitted vibration. Thereby, the lateral vibration of the stator 410 is not transmitted to the tub 200 through the fixing member 600.

When the stator 410 is vibrated in the longitudinal direction, the bushing 520 damps the vibration of the stator 410. Further, since the spacer 510 separates the stator 410 from the tub 200 and the head of the fixing member 600, the stator 410, which is vibrated in the longitudinal direction, does not collide with the tub 200 and the fixing member 600. Thereby, the longitudinal vibration of the stator 410 is not indirectly transmitted to the tub 200 through the fixing members 600, or is not directly transmitted to the tub 200.

As apparent from the above description, the present invention provides a mechanism for mounting a motor of a washing machine, in which isolators are installed on a stator of the motor and fixing members fix the stator to a tub through the isolators. The isolators prevent the stator from contacting the fixing members. Accordingly, the isolators absorb the vibration of the stator generated when the motor is driven, thereby efficiently preventing the vibration from being indirectly transmitted to the tub through the fixing members or from being directly transmitted to the tub. Thus, it is possible to prevent deformation and fatigue crack of the tub and damage to the stator, and to efficiently reduce noise generated when the motor is driven. Further, the fixing members do not directly contact the stator, and are supported by spacers of the isolators, thereby preventing damage to the stator due to excessive fixing force.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A mechanism for mounting a motor of a washing machine comprising:

a motor located on an outer surface of a tub;

at least one fixing member passing through a part of the motor and then fixed to the tub for fixing the motor to the tub; and at least one isolator provided between the motor and the corresponding fixing members to prevent the fixing members from directly contacting the motor to prevent the vibration of the motor from being transmitted to the tub through the fixing members, wherein the isolator is configured to provide an air gap between a head of the fixing member and a stator of the motor, wherein each of the isolators includes:

a spacer provided between the head of the fixing member and the tub to support the fixing member; and a bushing provided between the spacer and the motor to absorb the vibration of the motor, wherein the spacer includes a flange protruded from the outer surface thereof in the radial direction; and the bushing includes a recess provided in the inner surface thereof to receive the flange.

2. The mechanism as set forth in claim 1, wherein the spacer is made of a metal or synthetic resin material.

3. The mechanism as set forth in claim 1, wherein the bushing is made of elastic rubber.

4. The mechanism as set forth in claim 1, wherein the spacer separates the head of the fixing member from the motor.

5. The mechanism as set forth in claim 1, wherein the spacer separates the fixing member from the bushing.

6. The mechanism as set forth in claim 1, wherein the spacer is inserted into the bushing by push fit.

7. The mechanism as set forth in claim 1, wherein the bushing is inserted into a hole of the motor by push fit.

8. The mechanism as set forth in claim 1, wherein the bushing includes at least one enlarged part extended from the outer cylindrical surface thereof in the radial direction and contacting the inner surface of a hole of the motor, through which the fixing member passes.

9. The mechanism as set forth in claim 8, wherein the enlarged part is provided on upper and lower portions of the bushing.

10. The mechanism as set forth in claim 1, wherein the flange is provided at one end of the spacer such that the flange contacts the tub to disperse the force of the fixing member.

11. A washing machine comprising:

a case;

a tub provided in the case, and including at least one first hole provided in the outer surface thereof;

a drum rotatably provided in the tub;

a stator located on the outer surface of the tub, and including at least one second hole corresponding to the first hole;

a rotor connected to the drum by a driving shaft passing through the tub for rotating the drum through the driving shaft when power is applied to the stator;

at least one fixing member passing through the second hole and then inserted into the first hole to fix the stator to the tub; and at least one isolator provided between the inner surface of the second hole and the fixing member to prevent the fixing member from directly contacting the stator to prevent the vibration of the stator from being transmitted to the tub through the fixing member, wherein the isolator is configured to provide an air gap between a head of the fixing member and the stator, wherein the isolator includes:

a spacer made of a metal or synthetic resin material and provided in the second hole to support the fixing member; and a bushing made of an elastic material and provided between the outer surface of the spacer and the inner surface of the second hole to absorb the vibration of the stator.

12. The washing machine as set forth in claim 11, wherein the spacer separates the fixing member from the bushing and the stator.

13. The washing machine as set forth in claim 11, wherein the spacer is inserted into the bushing by push fit, and the bushing is inserted into the second hole by push fit.

14. The washing machine as set forth in claim 11, wherein the bushing includes enlarged parts extended from upper and lower portions thereof in the radial direction and contacting the inner surface of the second hole.

15. The washing machine as set forth in claim 11, wherein:

the spacer includes a flange protruded from the outer surface thereof in the radial direction; and the bushing includes a recess provided in the inner surface thereof to receive the flange.

16. The washing machine as set forth in claim 15, wherein the flange is provided at one end of the spacer such that the flange contacts the tub to disperse the force of the fixing member.

* * * * *